US006901865B1

(12) United States Patent
Thomson et al.

(10) Patent No.: US 6,901,865 B1
(45) Date of Patent: Jun. 7, 2005

(54) PRIMER CASING AND METHOD OF CHARGING A BLASTHOLE

(75) Inventors: Steven Thomson, Kurri Kurri (AU); Anthony M. Palmer, Kurri Kurri (AU); Andrew D. Hunter, Coal Point (AU)

(73) Assignee: Orica Explosives Technology Pty. Ltd., Melbourne (AU)

( * ) Notice: Subject to any disclaimer, the term of this patent is extended or adjusted under 35 U.S.C. 154(b) by 0 days.

(21) Appl. No.: 10/030,976

(22) PCT Filed: Jul. 7, 2000

(86) PCT No.: PCT/AU00/00824

§ 371 (c)(1),
(2), (4) Date: May 10, 2002

(87) PCT Pub. No.: WO01/04563

PCT Pub. Date: Jan. 18, 2001

(30) Foreign Application Priority Data

Jul. 9, 1999 (AU) ..... PQ1533

(51) Int. Cl.[7] ..... F42B 3/02; G01V 1/06; E21B 11/00; E21B 33/04; E21B 43/10

(52) U.S. Cl. ..... 102/319; 102/313; 102/321; 102/322; 175/4.52; 86/20.15

(58) Field of Search ..... 102/312, 313, 102/314, 319, 322, 275.6, 321; 175/4.52; 86/20.15

(56) References Cited

U.S. PATENT DOCUMENTS

| | | | | | |
|---|---|---|---|---|---|
| 855,224 | A | * | 5/1907 | Broadwater | 102/322 |
| 1,560,815 | A | * | 11/1925 | Hill | 102/319 |
| 2,491,692 | A | | 12/1949 | Shimek | 102/21.8 |
| 2,755,734 | A | * | 7/1956 | Smith | 102/319 |
| 3,280,742 | A | * | 10/1966 | Babb | 181/116 |
| 3,357,355 | A | * | 12/1967 | Roush | 102/318 |
| 3,599,567 | A | * | 8/1971 | Graham et al. | 102/319 |
| 3,939,771 | A | * | 2/1976 | McReynolds | 102/319 |
| 4,278,025 | A | * | 7/1981 | McReynolds | 102/319 |
| 4,470,352 | A | * | 9/1984 | Leperre | 102/333 |
| 4,961,381 | A | * | 10/1990 | McLaughlin | 102/319 |
| 5,131,465 | A | * | 7/1992 | Langston | 102/319 |
| 5,343,002 | A | * | 8/1994 | Gremillion | 181/116 |
| 5,811,741 | A | * | 9/1998 | Coast et al. | 181/101 |
| 5,860,482 | A | * | 1/1999 | Gremillion et al. | 175/19 |

FOREIGN PATENT DOCUMENTS

| | | | |
|---|---|---|---|
| DE | 41 36 096 | 12/1992 | |
| EP | 0 564 773 A1 | 10/1993 | |
| GB | 810528 | 3/1959 | |
| WO | WO 96/01408 | 1/1996 | F42D/1/22 |

* cited by examiner

*Primary Examiner*—Michael J. Carone
*Assistant Examiner*—James S. Bergin
(74) *Attorney, Agent, or Firm*—Greenlee, Winner and Sullivan, P.C.

(57) ABSTRACT

Primer casing (1) comprising sleeve portion (5) and leading portion (5*a*), wherein sleeve portion (5) includes tabs (6) to retain primer (11) and blasthole engagement means (2), and wherein leading portion (5*a*) comprises nose cone (8). Engagement means (2) comprises an array of rigid, multiple projections that are hinged and movable between a retracted position and a blasthole engagement position. Explosive loading hose (13) locales within hose receiving sleeve (7) and can be used to push primer casing (1) into the desired location within the blasthole prior to filling the blasthole with bulk explosive. Methods of loading a blasthole comprising inserting primer (11) into primer casing (1) and positioning primer casing (1) at a desired location in a blasthole are also described and claimed.

16 Claims, 2 Drawing Sheets

PRIMER CASING AND METHOD OF CHARGING A BLASTHOLE

CROSS-REFERENCE TO RELATED APPLICATIONS

Figure 2:
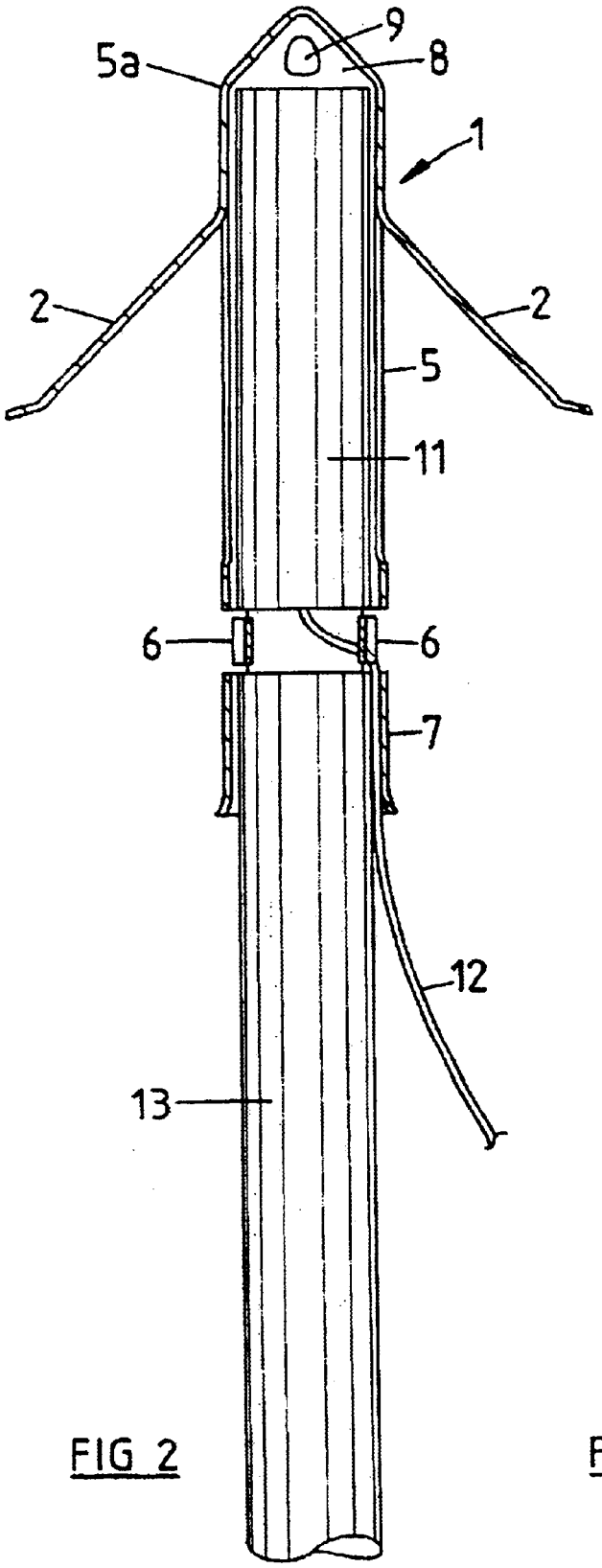

This application is a National Stage Application of PCT International Application No. PCT/AU00/00824, filed Jul. 7, 2000, which claims priority to Australian Patent Application No. PQ1533/99, filed Jul. 9, 1999, both of which are incorporated by reference in their entirety, to the extent not inconsistent with the disclosure herein.

The present invention relates to a primer casing and to a method of charging a blasthole.

Some mining methods involve drilling long blastholes into rock from within a development drive, i.e. a tunnel. These blastholes may be up to 50 meters in length and vary in diameter. The blastholes typically radiate from the development drive vertically, horizontally and at any angle therebetween. The blastholes are filled with explosives which, when detonated, break the surrounding rock. In practice, each blasthole contains a bulk explosive and an initiating explosive. The bulk explosive may be granular in nature, such as ANFO, or it may be an emulsion explosive. The initiating explosive typically consists of a primer and is responsible for detonation of the bulk explosive. The primer is typically a solid packaged explosive or an emulsion-based explosive in the form of a cartridge. When charging the blasthole the primer is positioned at a selected location or locations and this is done by pushing the primer into position by use of a loading hose. The loading hose is also used to deliver the bulk explosive to the blasthole adjacent to the primer.

Positioning of a primer at a desired location within a blasthole may be difficult due to obstructions and/or discontinuities within the blasthole. For instance, when an explosion takes place in the vicinity of an uncharged blasthole, the blasthole walls are subjected to stresses. This can lead to distortion of the walls resulting in sections of the blasthole being non-aligned or off-set. In this case, it may be difficult or even impossible to push the primer along the blasthole to the desired location. This is because the primer is usually in the form of a cylindrical cartridge having a leading surface which has a flat top and an acute edge. This kind of shape means that the primer is prone to snagging on obstructions and/or discontinuities in the blasthole as the primer is pushed into place. In this case the primer may not be positioned correctly and re-drilling of the blasthole may be required. This is time-consuming and uneconomic.

It is also important that the primer is retained in the blasthole in the desired position, and unwanted movement of the primer, for instance due to the effect of gravity or an unauthorised attempt to withdraw the primer, should preferably be minimised or avoided. In the past, "spiders" in the form of a circular band having outwardly projecting rigid legs have been used for retaining a primer in the desired position in a blasthole. However, such "spiders" have generally been provided as separate articles which must be fixed to a primer at the blasthole or mine site. As well as this being time-consuming, the packaging and transportation of such "spiders" is inefficient due to their irregular shape and rigidity of the projecting legs.

The present invention seeks to address these problems by providing a primer casing which is adapted to receive a primer and to be positioned in a blasthole even when the blasthole contains obstructions and/or discontinuities. Furthermore, the primer casing of the present invention enables the primer to be retained at a desired location within the blasthole, irrespective of the orientation of the blasthole or any unauthorised attempt to withdraw the primer. The primer casing thus permits improved loading of a blasthole.

Accordingly, the present invention provides a primer casing comprising a sleeve portion and a leading portion, wherein the sleeve portion is adapted to receive a primer and comprises a blasthole engagement means, and wherein the leading portion comprises a nose cone which is provided at one end and as an extension of the sleeve portion.

The sleeve portion of the primer casing is adapted to receive a primer and the exact construction of the sleeve portion will depend upon the shape and configuration of the primer. Typically however the primer is in the form of a cylindrical cartridge and the sleeve portion defines a cylindrical passage (or cavity) into which the primer cartridge may be slidably inserted. Other configurations for the sleeve portion are of course possible.

The passage of the sleeve portion is usually sized relative to the primer cartridge so that the cartridge is frictionally retained in the cavity or passage. However, in a preferred embodiment the primer casing is provided with means for retaining the primer within passage of the primer casing. The retaining means may be a tab, preferably a centrehinged (reversible) tab, which is integral with the sleeve portion of the casing and which may be extended into the cavity after insertion of the primer to engage the primer body (which may be suitably adapted to be so-engaged) or to support the end of the primer. The effect is that the primer is retained in position within the sleeve portion of the primer casing.

The leading portion of the primer casing comprises a nose cone. The nose cone is provided at one end, and as an extension, of the sleeve portion of the casing. The nose cone is less prone to snagging on obstructions and/or discontinuities than a flat-ended construction. Typically, the apex of the nose cone is rounded. The nose cone is typically deflected by obstructions and/or discontinuities rather than being snagged on them. Thus, the nose cone can assist in guiding the primer casing past and around obstructions and/or discontinuities in the blasthole.

In a preferred embodiment, the nose cone is hollow so that when, in place, the end of the primer does not contact the inside surface of the cone. In this embodiment the nose cone is able to absorb shock which might otherwise be communicated to the primer when the primer casing impacts against an obstruction and/or discontinuity in, or the end of, a blasthole during positioning of the primer casing in the blasthole. This helps to avoid damage to the primer. Use of a hollow nose cone also provides a saving in-materials cost.

The blasthole engagement means usually takes the form of a projection from the sleeve portion of the primer casing. In a preferred embodiment of the invention the blasthole engagement means is movable between a retracted position and a blasthole engagement position.

In the retracted position the blasthole engagement means may abut the sleeve portion of the casing. For example, in the retracted position the blasthole engagement means may be integral with the casing and attached thereto by a flexible hinge which enables the blasthole engagement means to be movable between the two positions. Alternatively, in the retracted position, the blasthole engagement means may be held adjacent to or within the casing, for example using retaining cord, wire or band. With the blasthole engagement means in the retracted position the primer casing lends itself to being packed and transported in an economic manner.

In the blasthole engagement position, the projection is typically inclined outwardly relative to the primer casing and rearwardly relative to the leading portion. The projection is relatively rigid so that when it engages the wall of a blasthole little deflection of the projection takes place. If the projection does not have sufficient rigidity, it will not be able to function to maintain the primer casing in a desired position in a blasthole when the casing is subjected to forces which would otherwise cause withdrawal of the casing along and from the blasthole. Generally the primer casing is provided with at least two and preferably three or four such projections. The primer casing may comprise more than one array of multiple projections. When more than one projection is used, the projections will typically be of equal length. Usually, the projection comprises a leg portion.

The end of each projection may be provided with a wall engagement means which enables the projection to run over the surface of a blasthole wall as the primer casing is inserted into the blasthole, but which is capable of engaging the wall surface to assist in preventing unintentional withdrawal/movement of the primer casing. The wall engagement means may be a spike or prong which is capable of engaging the surface of a blasthole wall.

The blasthole engagement means may be moved from the retracted position to the blasthole engagement position at the mine site or blasthole so as to enable benefit to be derived from the ability to economically pack and transport the primer casings. Whilst the blasthole engagement means may be manually moved between retracted and blasthole engagement positions, it is preferred that insertion of the primer into the primer casing causes the blasthole engagement means to be so-moved. This may be possible for example when the blasthole engagement means is integral with the primer casing and a portion of the blasthole engagement means is provided within the sleeve portion of the primer casing which is adapted to receive the primer. In this arrangement insertion of the primer into the sleeve portion forces the blasthole engagement means outwardly and into the blasthole engagement position.

The blasthole engagement means may be integral with the primer casing, and preferably forms part of the sleeve portion thereof. In a preferred embodiment of the invention the sleeve portion and leading portion are integral components of a unitary piece. In this embodiment, the entire assembly may be formed by injection moulding a plastics material using a single mould. Any plastics material may be used provided it imparts a desired level of rigidity to the casing. For instance, in order to prevent snagging, the nose cone of the casing should be sufficiently rigid to avoid undue deformation. If the nose cone is too easily deformed, it will not function in guiding the casing around or past obstructions and/or discontinuities in a blasthole wall. As described above, the blasthole engagement means should also exhibit a degree of rigidity in order to fulfil the desired function. As plastics which may be used, mention may be made of polyethylenes and polypropylenes.

The primer is usually in the form of a cylindrical cartridge having a rigid body. The cartridge is typically made of cardboard.

In a preferred embodiment of the present invention, in use a primer is inserted into the primer casing and this causes the blasthole engagement means to move from the retracted position to the blasthole engagement position. The primer casing may then be inserted into a blasthole for initiation of an explosives charge. The blasthole engagement means enables the primer casing to be retained in position with the blasthole from the time of loading through to detonation. This is achieved by interaction between blasthole engagement means and the walls of the blasthole so as to substantially retain the position of the primer casing, and thus the primer, within the blasthole.

The primer is initiated by a signal tube. Conventional initiation means may be used. Thus, electric, non-electric or electronic initiation means may be employed.

Usually the primer casing may be loaded into a blasthole by using a loading hose. The end of the loading hose typically makes contact with the end of the primer casing remote from the nose cone of the leading portion. Problems can occur when the end of the loading hose and primer casing do not sit coaxially together when the primer casing is pushed into the blasthole. In this situation the loading hose may be displaced to one side and its leading edge may snag on the blasthole wall. To avoid this, in a preferred embodiment the primer casing is adapted to receive the end of a loading hose. This helps to prevent displacement of the loading hose from the desired point of contact with the primer casing. Thus, the primer casing may preferably further comprise a loading hose engaging means such as a sleeve for receiving the primer. The loading hose engagement means may be an extension of the sleeve portion of the primer casing.

In one embodiment, the sleeve for engaging the end of the loading hose has an internal dimension slightly greater than the external dimension of the hose. The difference in dimension should be sufficient to accommodate a signal tube running from the end of the primer without damage to or abrasion of the tube. In this embodiment it is also preferred that the primer casing includes means for preventing contact between the end of the primer which is contained by the primer casing and the end of the loading hose. The primer casing may therefore include a tab (or tabs) which projects into the sleeve portion of the primer casing. To facilitate insertion of the primer it is preferred that the tab may be moved into a position in which it projects into the sleeve portion after the primer has been inserted into the casing. In a preferred embodiment the primer retaining means described above also serves to prevent contact between the primer and the loading hose.

The loading hose serves to push the primer casing into the desired location within the blasthole. Bulk explosive is then pumped through the loading hose into the blasthole. It is desired that the bulk explosive is in intimate contact with the primer and preferably the primer is surrounded by bulk explosive. To this end the primer casing may include a number of apertures to enable bulk explosive to contact the primer. Preferably the sleeve portion include such cavities. The hose, when discharging bulk explosive, will separate from the primer casing and fill the blasthole with bulk explosive whilst being withdrawn from the blasthole. Bulk explosive may flow into any spaces between the blasthole wall and the primer casing and may contact the primer directly via the apertures in the casing.

In a further aspect, the primer casing may be provided with connector means whereby a plurality of primer casings may be interconnected such that the leading primer casing which is positioned by the hose drags subsequent primer casings into the blasthole. The separation distance between primer casings may be determined by the length of the interconnection between the primer casings. In a preferred configuration the connector means may be an aperture at either end of the primer casing such that the primer casings may be tied together with a length of signal tube, string, wire or the like. This kind of "train loading" is typically employed in larger diameter blastholes, for instance 89 mm or 102 mm.

This greatly speeds up the loading process. It is possible to employ "train loading" in smaller diameter blastholes, say 76 mm, but only if the walls thereof are relatively smooth. In this type of loading bulk explosive is pumped into the blasthole continuously as the loading hose is withdrawn from the blasthole thereby engulfing the primers.

Loading problems tend to be associated with smaller rather than larger diameter blastholes. Thus, the present invention is typically employed in loading blastholes having a diameter of from about 70 to about 110 mm, for instance 76 mm, 89 mm or 102 mm in diameter.

In practice, the primer casing has an internal diameter of about 35 mm. The diameter of the primer cartridge is slightly less than this. A primer casing of this internal diameter is typically used in conjunction with a loading hose having an external diameter of about 28 mm. In this case the signal tube (diameter typically 3 mm) is easily accommodated in the gap between the loading hose and the primer casing, the clearance being about 4 mm. If a larger diameter loading hose is used, for instance, 32 mm diameter, there signal tube may still just be accommodated.

The present invention further provides a method of loading a blasthole which comprises inserting a primer into a primer casing as described herein and positioning the primer casing at a desired location in the blasthole. Usually, the primer casing is positioned using a loading hose. After positioning of the primer casing, the blasthole is charged, usually via the loading hose, with bulk explosive.

The present invention further provides a method of loading a blasthole wherein a plurality of primers are positioned, spaced apart, in a blasthole wherein said plurality of primers are interconnected such that the positioning of the first primer will cause the subsequent primers to be positioned within said blasthole.

Figure 1:
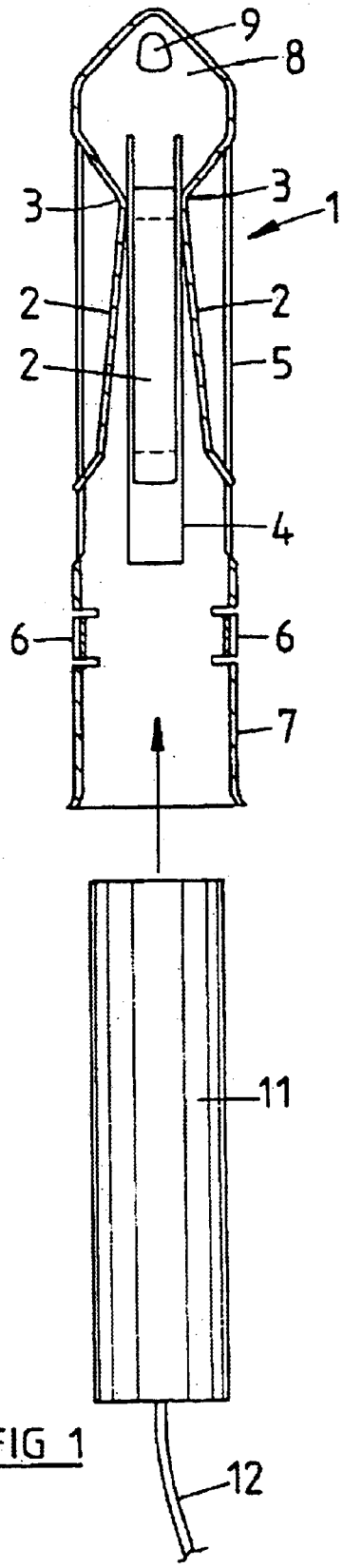
Figure 3:
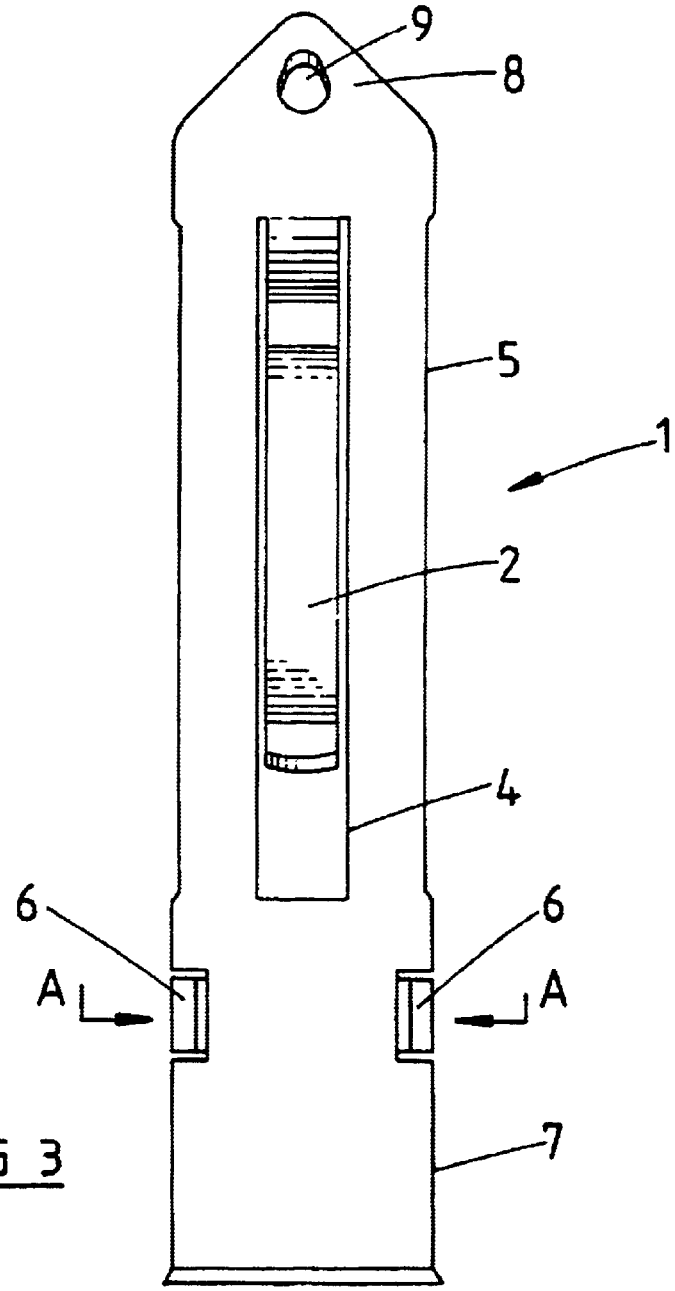
Figure 4:
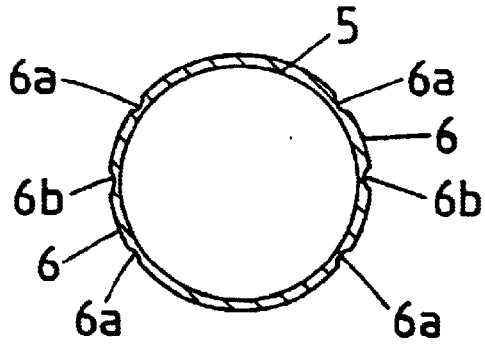

The present invention will now be further described with reference to the accompanying drawings. The drawings show primer casings which, when used with primers and initiating systems have been proven to initiate bulk explosives reliably. FIG. 1 is a cutaway representation of a primer casing (1) in accordance with the present invention and shows also a primer cartridge (11) prior to insertion therein. FIG. 2 is a cut away representation of a primer casing (1) having a primer inserted therein as well as the leading end of a loading hose (13). FIG. 2 shows a primer casing (1) including a sleeve portion (5) and a leading portion **(5*a*). FIG. 3 is a side view of a primer casing (1). FIG. 4 is a cross section through A—A shown in FIG. 3. In FIGS. 1 and 3 the blasthole engagement means (2) are in the retracted position. In FIG. 2** the blasthole engagement means are in the blasthole engagement position.

More specifically, FIG. 1 shows a primer casing (1) having four blasthole engagement means (2) in the form of projecting legs, only three of which can be seen. Each of the legs incorporates an inward projection (3) formed by a bend in the leg. The legs (2) are integrally formed with the primer casing (1) and extend into the passage (4) defined by the sleeve portion (5). The passage (4) allows the legs to be retained within the sleeve portion (5) of the primer casing (1) for packaging and transportation. The legs are urged outwards on insertion of the primer (11) into the primer casing (1). The primer (11) is retained within the primer casing (1) in a position in which the blasthole engagement means (2) are urged outwards by the camming of inward projections (3) over the primer (11). The primer (11) is retained in this position by the over centre tabs (6) which may be depressed into a locking position as shown in FIG. 2. The over centre tabs (6) also act to prevent the loading hose (13) from striking against the primer (11) and deforming the signal tube (12) which extends from the primer (11). The sleeve portion (5) extends to form a hose receiving sleeve (7). The top of the primer casing (1) includes a nose cone (8) in which there is provided apertures (9).

As illustrated in FIG. 4 the over centre tabs (6) have flexible hinges, **(6*a*, 6*b* and 6*a*). The hinges (6*a*) allow the over centre tab to depressed inwardly and the central hinge (6*b*)** permits the over centre tab to deform and stably retain a locked position.

An embodiment of the invention will now be described with reference to the following example.

EXAMPLE

A series of blastholes (diameter 89 mm and 102 mm) were drilled in a formation. The formation was highly stressed and prone to movement. A number of blastholes were charged with bulk explosive and blasted. Surrounding uncharged blastholes were thus subjected to blast induced damage.

Attempts were made to load the uncharged blastholes with primer using a mechanical hose pusher. In one series of tests, attempts were made to load a cylindrical primer cartridge to which was attached a ring having leg-like blasthole engagements means (a "spider" as described herein). The leading end of the primer was flat and acute. In another series of tests, primer was inserted into a primer casing in accordance with the present invention.

Severe difficulties were encountered in the first series of loading tests. The primer became snagged in the blasthole and could not be fed using the mechanical hose pusher. In order to advance the primer along the blasthole it became necessary to twist and turn the loading hose as well as repeatedly moving the primer backwards and forwards. This manual manipulation is very time consuming and uneconomic. In certain instances the primer could not be positioned correctly, even with manual manipulation of the loading hose.

In contrast, no loading problems at all were encountered when using the primer casing in accordance with the present invention. The mechanical pusher was able to achieve insertion of the primer without difficulty, thereby avoiding the need for manual intervention.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

What is claimed is:

1. A primer casing comprising a an elongate sleeve portion and a leading portion as integral components of a unitary piece and a loading hose engagement means, wherein the elongate sleeve portion defines a passage that is adapted to receive and encase a primer when the primer is slidably inserted into the passage, wherein the elongate sleeve portion comprises a blasthole engagement means as an integral part of the sleeve portion, wherein the leading portion comprises a nose cone which is provided at one end and as an extension of the sleeve portion, and wherein the loading hose engagement means comprises an extension at the end of the elongate sleeve portion remote from the nose cone.

2. A casing according to claim 1, wherein the elongate sleeve portion defines a passage that is adapted to receive and encase a primer in the form of a cylindrical cartridge.

3. A casing according to claim 1 or 2, wherein the sleeve portion defines a cylindrical passage into which a primer may be slidably inserted.

4. A casing according to claim 1, wherein the primer casing further comprises a primer retaining means that is adapted to retain a primer when slidably inserted into the elongate sleeve portion such that the sleeve portion encases the primer.

5. A casing according claim 1, wherein the apex of the nose cone is rounded.

6. A casing according to claim 1, wherein the blasthole engagement means comprises a projection from the elongate sleeve portion.

7. A casing according to claim 1, wherein the blasthole engagement means is moveable between a retracted position and a blasthole engagement position.

8. A casing according to claim 7, wherein the blasthole engagement means is integral with the casing and attached thereto by a flexible hinge which enables movement between retracted and blasthole engagement positions.

9. A casing according to claim 7 or claim 8, wherein in the retracted position the blasthole engagement means abuts the elongate sleeve portion.

10. A casing according to any of claims 7 to 9, wherein in the blasthole engagement position the projection is inclined outwardly relative to the primer casing and rearwardly relative to the leading portion.

11. A casing according to any of claims 7 to 9, wherein the projection comprises at its end a blasthole wall engagement means.

12. A casing according to claim 1, wherein the end of the sleeve portion remote from the nose cone is adapted to engage the end of a loading hose and has an internal dimension greater than the external dimension of the end of the loading hose.

13. A casing according to claim 12, further comprising means for preventing contact between a primer when encased by the sleeve portion and a loading hose when the loading hose is engaged by the sleeve portion.

14. A casing according to claim 1, comprising a number of apertures in the elongate sleeve portion.

15. A method of loading a blasthole, which method comprises the steps of inserting a primer into a primer casing as claimed in any of claim 1, 2, 4, 5, 6, 7, 8, or 12 and positioning the primer casing at a desired location in the blasthole using a loading hose.

16. A method of loading a blasthole, which method comprises the steps of inserting a primer into a primer casing as claimed in claim 1, 2, 4, 5, 6, 7, 8, or 12, positioning the primer casing at a desire location in the blasthole using a loading hose, and charging the blasthole with bulk explosive.

* * * * *